US006523668B2

(12) United States Patent
Wolz

(10) Patent No.: US 6,523,668 B2
(45) Date of Patent: Feb. 25, 2003

(54) GUIDING AND STACKING SYSTEM FOR SHEET METAL PARTS

(75) Inventor: Dieter Wolz, Heiningen (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 70 days.

(21) Appl. No.: 09/779,589

(22) Filed: Feb. 9, 2001

(65) Prior Publication Data

US 2002/0011396 A1 Jan. 31, 2002

(30) Foreign Application Priority Data

Feb. 9, 2000 (DE) ..... 100 05 752

(51) Int. Cl.[7] ..... B65G 47/10
(52) U.S. Cl. ..... 198/369.2; 198/369.2
(58) Field of Search ..... 198/369.2, 429, 198/461.1, 435, 436

(56) References Cited

U.S. PATENT DOCUMENTS 5,078,255 A * 1/1992 Haley ..... 198/358
5,422,467 A * 6/1995 Graef et al. ..... 198/358
5,671,837 A * 9/1997 Tazou et al. ..... 198/369.2
5,692,593 A * 12/1997 Ueno et al. ..... 198/369.2
5,810,149 A * 9/1998 Sandberg et al. ..... 198/369.2
6,227,377 B1 * 5/2001 Bonnet ..... 198/435
6,279,721 B1 * 8/2001 Lyngso et al. ..... 198/369.2

FOREIGN PATENT DOCUMENTS

EP 0627372 12/1994

* cited by examiner

*Primary Examiner*—Christopher P. Ellis
*Assistant Examiner*—Richard Ridley
(74) *Attorney, Agent, or Firm*—Crowell & Moring LLP

(57) ABSTRACT

A guiding and stacking system, is provided particularly for guiding and stacking sheet metal parts which are supplied by a press system. The system has a distributing guide which branches the parts flow to two or more guiding and stacking belts. In their entirety or in parts, the guiding and stacking belts operate in the start/stop operation and thus permit the transfer to mechanical gripper devices or manual removal of the sheet metal parts.

12 Claims, 4 Drawing Sheets

GUIDING AND STACKING SYSTEM FOR SHEET METAL PARTS

This application claims the priority of German Application NO. 10005752-7, filed Feb. 9, 2000, the disclosure of which is expressly incorporated by reference herein.

BACKGROUND OF THE INVENTION

The present invention relates to a guiding and stacking system having a removal transport system which has a first conveying device which is set up for receiving the sheet metal parts and which has a controllable driving device which defines the conveying speed of the removal transport system, having a distributing guide, which has a second conveying device which is set up for receiving the sheet metal parts and which has a controllable driving device which defines the conveying speed of the second conveying device, having at least two stacking transport systems which each have another conveying device which is set up for receiving the sheet metal parts and which each have a controllable driving device which defines the conveying speed of the respective guiding and stacking transport system the distributing guide at least temporarily being changeable into a first position in which it adjoins one of the guiding and stacking transport systems and the distributing guide at least temporarily being changeable into a second position in which it adjoins the other guiding and stacking transport system.

Press systems, particularly vehicle body presses, supply sheet metal parts corresponding to their working cycle that have to be removed in a sequenced manner. Even when manufacturing very large sheet metal parts, such as motor vehicle side walls, doors or other sheet metal parts, press working lines reach working rates of approximately 15 strokes per minute. The sheet metal parts, which are obtained synchronously, should be removed and transported away without any damage. In each case, this has to take place in a fail-safe manner so that the operation of the press system will not be hindered. A frequent requirement is that a failure of an automatic guiding and stacking system will not lead to a stoppage of the press system or another production device disposed on the input side. A manual removal of sheet metal parts, which may weigh approximately 50 kg and are delivered at a 4-second cycle, is not easily possible. A failure of an automatic guiding and stacking system therefore usually results in a stoppage of the production device disposed on the input side.

SUMMARY OF THE INVENTION:

An object of the present invention is to provide a high availability guiding and stacking system for sheet metal parts.

This object has achieved by a guiding and stacking system for sheet metal parts in which the conveying devices of the guiding and stacking transport systems each have at least one section operating in the start/stop operation.

The guiding and stacking system has a removal transport device which receives parts delivered by a system disposed on the input side, such as sheet metal parts delivered by a press system, and supplies them to a distributing guide. The distributing guide services two or several connected guiding and stacking transport systems which are alternately supplied with sheet metal parts. As a result, each guiding and stacking transport system receives only a fraction (half or less) of all sheet metal parts received by the removal transport system.

Each guiding and stacking transport system transports the sheet metal parts to one stacking site respectively, at which the sheet metal parts are then removed and stacked, for example, on pallets. For this purpose, corresponding gripper devices can be used which remove the sheet metal parts from the stacking and removing transport system and deposit them on pallets. The sheet metal parts arrive on the guiding and stacking transport system at a lower consecutive frequency than that at which they are delivered by the system, such as the press system. As a result of the reduced frequency, they can, as required or in an emergency, also be removed and stacked manually, whereby, even in the event of a failure of the gripper devices, the operation of the press system disposed on the input side can be continued.

The guiding and stacking transport conveying device has at least one section which stops temporarily. This makes it possible for an automatic gripper device arranged on the output side as well as for personnel assisting at times to grip the sheet metal parts and to remove and deposit them in a sequenced manner. In connection with the distributing guide, which is connected on the input side and which reduces the number of the sheet metal parts arriving per time unit (i.e., frequency), it therefore becomes possible, also at a high working rate of the press system (15 strokes per minute) and relatively large and therefore also heavy sheet metal parts, to manually remove and stack as an auxiliary measure in order to be able to continue the operation of the press system in special situations. Thus, the overall availability as a whole is increased.

The removal conveying device, the guiding and stacking device and/or the distributing guide conveying device can each be constructed as a conveyer belt. This has the advantage that no adaptation to different sheet metal parts is required. Furthermore, a careful transport of the sheet metal parts is ensured which is independent of the position.

The removal conveying device and the guiding and stacking conveying device, that is, for example, the moving belts of the removal transport system and of the guiding and stacking transport system move preferably at least temporarily at the same speed. This speed preferably corresponds to the conveying speed of the distributing guide. Thereby a good transition of the sheet metal parts from the removal conveying device to the distributing guide and from the distributing guide to the removal and stacking conveying device is ensured.

While the distributing guide conveying device is preferably continuously driven, the removal conveying device runs, for example, in the start/stop operation and, only for the transfer of the sheet metal parts to the distributing guide, has the same transport speed as the distributing guide. The average moving speed of the removal conveying device, however, is lower during the start/stop operation than that of the distributing guide. The corresponding situation exists with respect to the average speed of the guiding and stacking conveying device which, for example, can have a uniform conveying speed and thus, on the whole, can be driven in the start/stop operation. The average speed of the guiding and stacking conveying device will than be lower than that of the distributing guide. This also applies when only a section of the guiding and stacking conveying device is driven in the start/stop operation. It may be sufficient, for example, to operate the end of the guiding and stacking conveying device which is situated away from the distributing guide in the start/stop operation in order to permit a sequenced removal of the sheet metal parts and not have to accelerate and decelerate the entire conveying device.

By distributing the parts flow to several guiding and stacking conveying devices by way of the distributing guide, the average speed of the guiding and stacking conveying device can be lower than that of the removal conveying device. The low average speed of the guiding and stacking conveying device facilitates the manual guiding and stacking as well as the automatic access by robots.

This also applies to a spatial separation of the stacking sites which should preferably take place, the guiding and stacking transport systems leading to these stacking sites.

BRIEF DESCRIPTION OF THE DRAWINGS

Other objects, advantages and novel features of the present invention will become apparent from the following detailed description of the invention when considered in conjunction with the accompanying drawings.

Other objects, advantages and novel features of the present invention will become apparent from the following detailed description of the invention when considered in conjunction with the accompanying drawings.

BRIEF DESCRIPTION OF THE DRAWINGS

Figure 1:
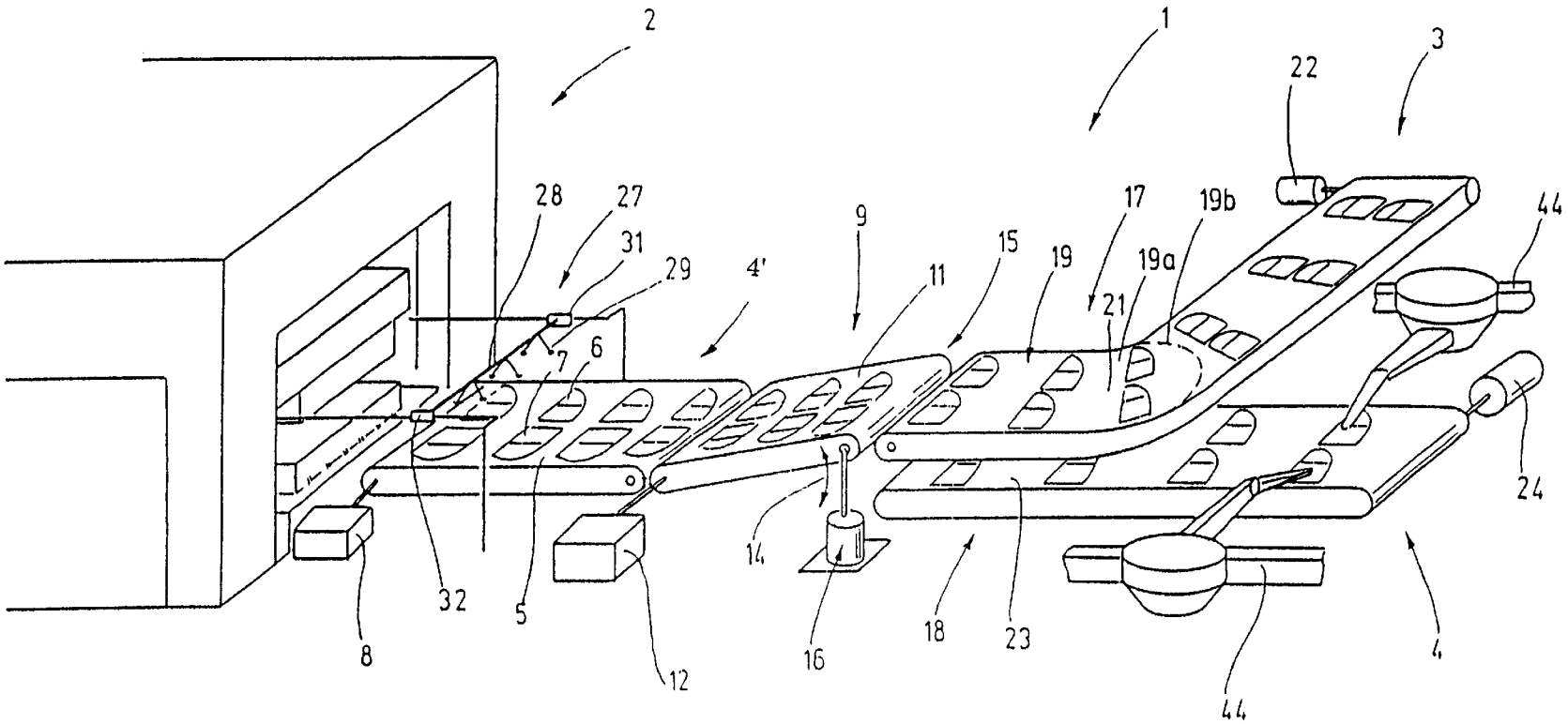
Figure 2:
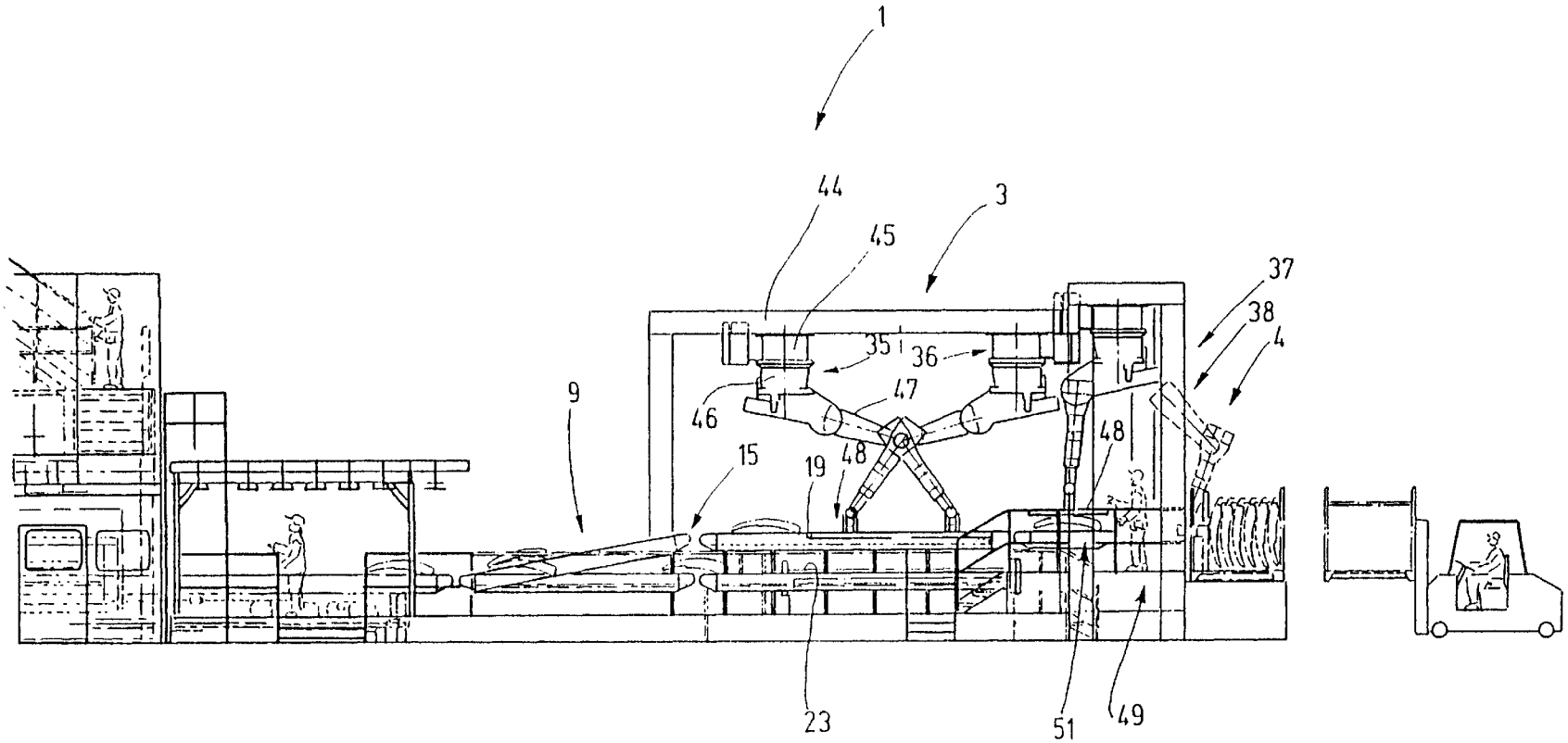
Figure 3:
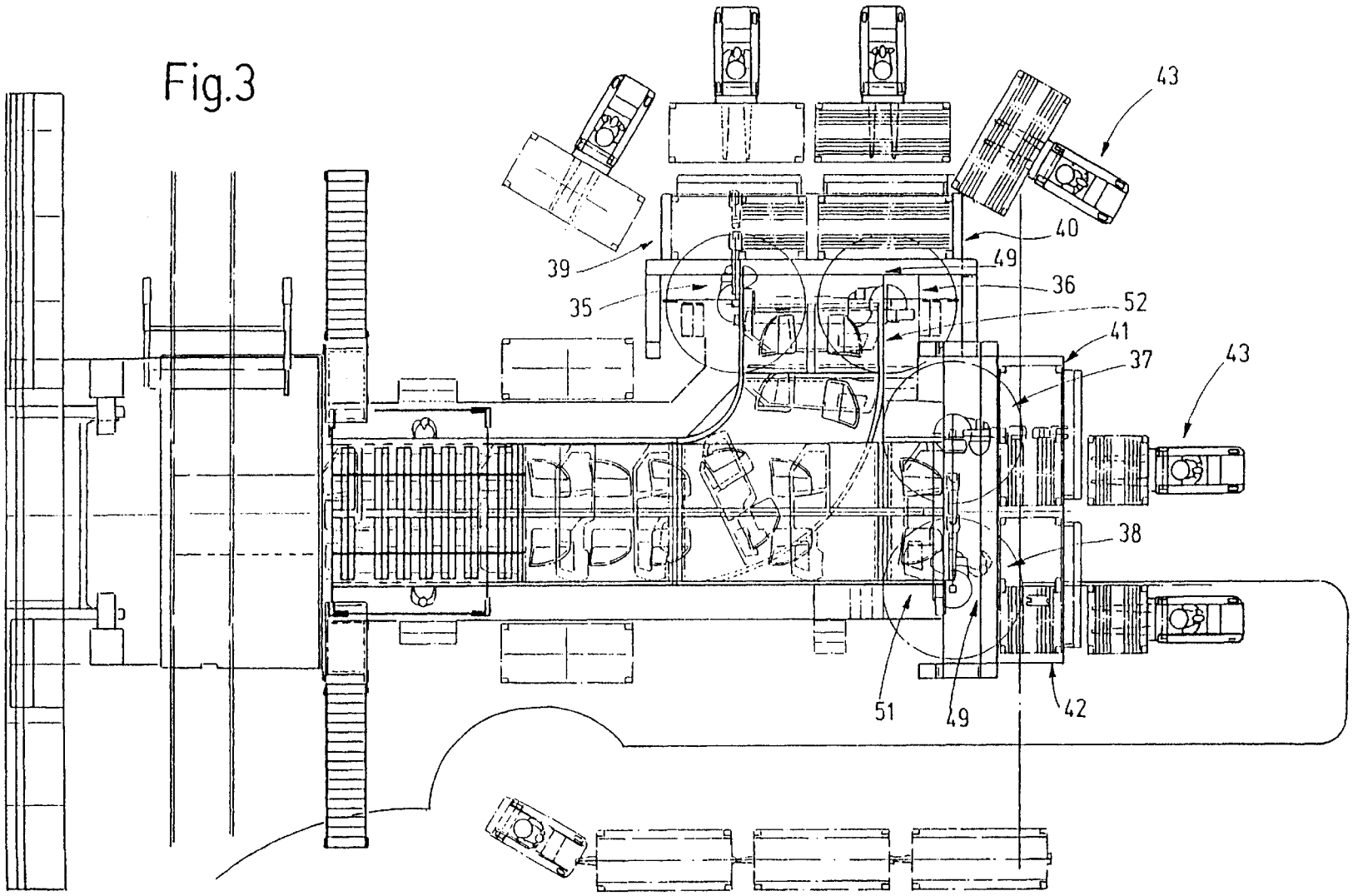
Figure 4:
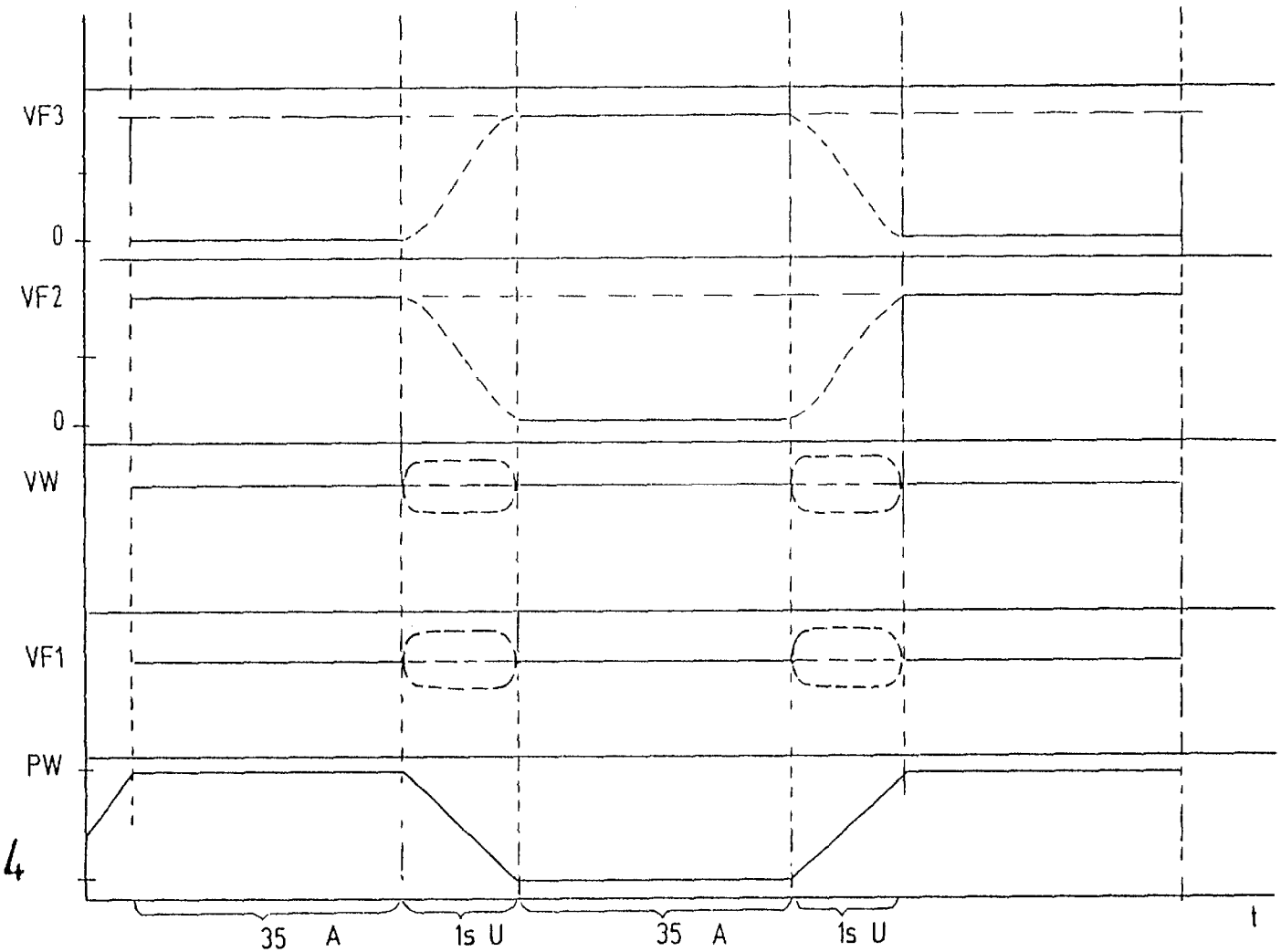

FIG. 1 is a perspective schematic view of a guiding and stacking system according to the present invention;

FIG. 2 is a schematic side view of a guiding and stacking system similar to FIG. 1;

FIG. 3 is a schematic top view of the guiding and stacking system according to FIG. 2; and FIG. 4 is a time diagram of various conveying speeds of the transport systems pertaining to the guiding and stacking system of the present invention.

DETAILED DESCRIPTION OF THE DRAWINGS

FIG. 1 illustrates a guiding and stacking system 1 which guides the sheet metal parts supplied by a press system 2 to two mutually spaced stacking sites 3, 4 and to then stacking the sheet metal parts there. For this purpose, the guiding and stacking system 1 has several transport systems.

Directly adjoining the press system 2, a removal transport system 4' in the form of a belt conveyor is set up. It has a conveyer belt 5 with a horizontally oriented top side which conveys the removed sheet metal parts 6, 7 in a laying position and is therefore used as a removal conveying device. The removal transport system 4' has a driving device 8 used for driving the conveyer belt 5. This conveyer belt 5 is guided by way of at least two guide pulleys of which at least one is driven by the driving device 8. The driving device therefore determines the conveying speed of the conveyer belt 5 and is subjected to the control of a known type of control device. This control device therefore defines the moving speed of the conveyer belt 5 as well as its starting and stopping. The control device, in turn, can be controlled by known sensors to detect the positions of the parts 6, 7 on the conveyer belt 5.

For the further laying transport of the sheet metal parts 6, 7 as well as for the distribution to different conveying tracks, a distributing guide 9 is provided which is also constructed as a belt conveyer device. For this purpose, the distributing guide 9 has a conveyer belt 11 guided around two mutually parallel, horizontally oriented rollers. At least one of the rollers is connected with a driving device 12 for driving the conveyer belt 11 at a defined speed. The driving device 12 is subjected to the control of a control device which defines identical belt speeds for the parts transfer from transport belt 5 to transport belt 11. In order to permit a parts transfer which is as undisturbed as possible, the transport belt 11 directly adjoins the transport belt 5. That is, the rollers arranged here for deflecting the respective conveyer belt 5, 11 are aligned parallel to one another and are arranged to be closely adjacent to one another as well as at the same level.

As illustrated in FIG. 1 by an arrow 14, and 15 of the distributing guide 9, situated away from the removal transport system 4 can swivel vertically upward and downward, with the distributing guide 9 having at least two swivelling end positions. For swivelling the distributing guide 9, a corresponding drive 16 is provided which lifts or lowers the corresponding end 15 of the distributing guide or adjusts and fixes a desired level position.

The distributing guide 9 is adjoined by at least two guiding and stacking transport systems 17, 18 for the laying parts conveyance which convey from the distributing guide 15 to the stacking sites 3, 4. The guiding and stacking transport system 17 is arranged above the guiding and stacking transport system 18 which is a belt conveyer with a horizontal belt. The guiding and stacking transport system 17 is provided with a driving device 22 which defines the moving speed of the conveyer belt 19 as well as its starting and stopping condition.

At least one of the guiding and stacking transport systems 17, 18 contains a curve-type or bent conveying device. The guiding and stacking transport system 17 is a curve-type belt conveyer, as described, for example, in DE 3421413 and by itself, does not form the present invention. The conveyer belt 19 of the curve-type belt conveyer negotiates curves and is guided on the desired track by guiding devices. As a result, the guiding and stacking transport system 17 can convey deviating from the original conveying direction defined by the distributing guide 9, as illustrated in FIG. 1. Thus, a spatial separation or disentanglement can be achieved of the conveyer tracks separated by the distributing guide 9. Thus, individual stacking sites, which each take up a considerable amount of space, can be arranged in a hangar to be so far away from one another that the operations at the stacking sites do not hinder each other or interfere with one another.

The guiding and stacking transport system 18 is arranged at a distance under the guiding and stacking transport system 17. This distance permits the passage of curved sheet metal parts 6, 7. It is constructed as a belt conveyer device and is equipped with a conveyer belt 23. For the drive, a driving device 24 is used which can set a desired speed of the conveyer belt and can cause this conveyer belt to start and stop in a targeted manner.

Both driving devices 22, 24 are subjected to a control which can be connected with sensors which detect the position of the sheet metal parts 6, 7 and report that position to the control device. The control device controls the conveyer belts 19, 23 correspondingly, so that the conveyer belts always have a coinciding or coordinates conveying speed at least when a sheet metal part is transferred from one conveyer belt to the respective following conveyer belt.

The conveyer belts 19, 23 directly adjoin the end 15 of the distributing guide 9 in the upper and the lower position. A gap existing in each case between the distributing guide 9 and the conveyer belts 19, 23 is so narrow that the sheet metal parts 6, 7 are transferred without difficulty from the distributing guide 9 to the respective guiding and stacking transport system 17, 18.

A removal feeder 27 transfers the sheet metal parts 6, 7 from the press system 2 onto the removal transport system 4. The removal feeder 27 has a suction bar 28 which carries several sucking devices 29 on its underside. By way of its two ends, the suction bar is held, for example, by travelling carriages 31, 32. At the working cycle of the press system 2, the suction bar 28 moves in each case into press system 2 into the opening tools, removes the sheet metal parts or parts 6, 7 from there and guides them out of the press system 2 in order to deposit them on the removal transport system 4 or its transport belt 5.

Gripping devices 35, 36 and 37, 38 (FIG. 3) are provided at the stacking sites 3, 4. These gripping devices remove the sheet metal parts 6, 7 from the respective transport belt 19, 23 and stacking them on pallets 39, 40, 41, 42 which can then be moved away by fork lifts 43.

The gripping devices 35 to 38 essentially have a mutually identical construction. They each have a head 46 which is held on a bridge frame 44 and is disposed to be swivellable 45 about a vertical axis, with an arm 47 projecting laterally away from the head 46 which can be swivelled in a targeted manner by way of a conventional drive. The arm 47 is disposed on the head 46 to be swivellable about a horizontal axis, i.e., it can be lifted and lowered. Furthermore, the arm 47 is provided with additional hinges. At its free end, it carries, for example, a suction spider 48 or gripper tongs in order to be able to receive parts in a targeted manner. For fastening the gripper tongs, the suction spiders or other toolings, suitable receiving devices can be provided on the arm 47. This permits an automatic suction spider exchange or an exchange of the tooling. In addition, the arm 47 can also be constructed to be telescopable or optionally rotatable in a targeted manner, corresponding drives and sensors existing at each hinge or deflection point.

In addition to the gripping devices 35 to 38, standing spaces 49 for personnel are provided at the stacking sites 3, 4, for controlling or for emergency stacking. The standing spaces are, in each case, arranged between the guiding and stacking transport systems 17, 18 and the standing spaces for the pallets 42.

As illustrated in FIG. 1, the guiding and stacking transport systems may have continuous transport belts 19, 23, whereby then, in each case, a uniform, although time-dependent conveying speed will be achieved on the entire respective guiding and stacking system 17, 18. Preferably, the guiding and stacking transport systems can be divided as indicated in FIGS. 2 and 3, in contrast to FIG. 1. In FIG. 1, the upper guiding and stacking transport system 17 is configured to negotiate curves, and the lower guiding and stacking transport system 18 is configured to be straight. Deviating therefrom, the assignment may also be reversed, or both guiding and stacking transport systems 17, 18 may be constructed to negotiate curves.

According to FIGS. 2 and 3, sections 51, 52 are constructed at the end of the respective guiding and stacking system 17, 18 as an independent belt conveyer with an independent driving device. In the transport direction, the length of this section 51, 52 is preferably approximately so large that a part or a pair of parts can be placed on this section. This permits limitation of the starting/stopping operation of the guiding and stacking transport system 17, 18 to in each case only a short section. thereby, the entire conveyer belt 19, 23 does not have to be accelerated or decelerated in a short succession. On the section operated during the starting and stopping operation, the sheet metal part will then be still for a short time, for the transfer to the respective gripping device 35 to 38.

As illustrated in FIG. 4, the guiding and stacking system 1 is operated in the time periods A at the defined speeds of the removal transport system 4, of the distributing guide 9 and of the guiding and stacking transport systems 17, 18. Particularly in interim time periods U, in which the distributing guide 9 changes over, the speeds can be set such that, for example, desired parts positions are reached for synchronizing the parts flow. In the time periods U, the control device can accelerate or decelerate individual belts in order to then move the sheet metal parts, for example, to defined sites, such as the transfer point. The synchronization phases U can be utilized for correcting inaccuracies of the sheet metal parts position in the transport direction which occur when the sheet metal parts are deposited on the transport belts.

During operation of the press system 2, the suction bridge 28 deposits at the working cycle of the press system 2, i.e., for example, every four seconds, a sheet metal part or a pair of sheet metal parts 6, 7 on the transport belt 5 of the removal transport system 4. As illustrated in FIG. 4, the conveyer belt 5 runs at a speed VF1 in this case. As required, the movement of the conveyer belt 5 can be increased or decreased for a short time, as indicated in FIG. 4, by corresponding control of the driving device 8. It can, for example, stop briefly for taking over sheet metal parts. However, the transport belt 5 can also run at a constant speed.

The distributing guide 9 is moved back and forth between its upper and its lower position in the working cycle of the press system 2, as outlined in the bottom diagram in FIG. 4, which diagram illustrates the position PW of the end 15 of the distributing guide 9. For one working cycle of the press system 2 respectively, i.e., for example, for barely four seconds, the distributing guide 9 assumes its upper position, while, in the subsequent working cycle, it assumes it lower position. In this case, the working cycle of the distributing guide 9 can have a phase offset with respect to the working cycle of the press system 2.

As illustrated in the diagram of FIG. 4, the transport belt 11 of the distributing guide 9 also preferably runs at a constant speed VW. In this situation, the transport speed VW of the transport belt 11 corresponds to the conveying speed VF1 of the removal transport system 4. This applies particularly, at the moment of the transfer of the sheet metal parts 6, 7 from conveyer belt 5 to conveyer belt 11, which can be ensured by corresponding sensors and the controlling of the driving devices 8, 12 and is illustrated in the diagrams of the speeds VW and VF1 by thick drawn-out lines.

By alternating switching of the distributing guide 9, the distributing guide 9 connects the conveying track for the sheet metal parts 6, 7 alternately to the guiding and stacking transport system 17 and the guiding and stacking transport system 18. This guiding and stacking transport system runs either in its entirety or, which is preferable, at least on its end, that is, at the stacking site 3, 4, in the start/stop operation. In the latter case, the running speed of the conveyer belts 19, 23 corresponds to the running speed of the conveyer belt 11 of the distributing guide 9.

The area 51, 52 operated in the start/stop operation has, however, a conveying speed VF2 and VF3 as illustrated in FIG. 4. The sections 51, 52 are each driven only for taking over a sheet metal part or a pair of sheet metal parts 6, 7, in which case they will then again be still for a certain pause period. The distributing guide 9, for example, switches every four seconds. Thus, the sheet metal parts arrive approximately every eight seconds on the guiding and stacking transport system 17 as well as on the guiding and stacking transport system 18. Of these eight seconds, in each case for example, one second is required for acceleration and deceleration of the sections 51, 52, while three seconds are available for transfer of the sheet metal parts to the section 51, 52 operated in the start/stop operation. An additional three seconds are available for the removal of the sheet metal parts, when the respective section 51, 52 is still. Thus, these three seconds will be available for the removal of the sheet metal parts 6, 7 by the gripper devices 35, 38, the remaining seven seconds then are available to the gripper device for depositing (stacking) of the sheet metal parts and for the return operation.

If, for example, as a result of a fault in the gripper devices, a faulty positioning of the pallets or an omission of their removal occurs, a manual guiding and stacking operation should be required, personnel can be used for taking the sheet metal parts off the sections 51, 52 and removing them manually. The total available time of 8 seconds for each sheet metal part is sufficient for being able to carry out this activity, until the mechanical operation can be continued.

A guiding and stacking system, which is provided particularly for the guiding and stacking of sheet metal parts which are supplied by a press system 2, has a distributing guide 9 which branches the parts flow to two or several guiding and stacking belts 17, 18. In their entirety or in part, the guiding and stack belts operate in the start/stop operation and therefore permit the transfer to mechanical gripper devices 35 to 38 or the manual removal of the sheet metal parts.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Guiding and stacking system, for a press system comprising, a removal transport system having a first conveying device configured to receive side-by-side sheet metal parts and having a controllable drive which defines a conveying speed of the removal transport system, a distributing guide having a second conveying device configured to receive and deliver the side-by-side sheet metal parts, and having a controllable drive which defines a conveying speed of the second conveying device, and at least two stacking transport systems each having an additional conveying device, each being configured to receive the side-by-side sheet metal parts from the second conveying device and having a controllable drive which defines a conveying speed of a respective guiding and stacking transport system, wherein the distributing guide is at least temporarily changeable into a first position which adjoins one of the guiding and stacking transport systems, and into a second position which adjoins another of the guiding and stacking transport systems, and the additional conveying devices of the guiding and stacking transport systems are each configured with at least one section operatable in start/stop operation.

2. The guiding and stacking system according to claim 1, wherein at least one of the first conveying device transport system, the additional conveying devices and the second conveying device is a conveyer belt.

3. The guiding and stacking system according to claim 1, wherein the additional conveying devices each have at least one section with a conveying speed which corresponds to the conveying speed of the first conveying device.

4. The guiding and stacking system according to claim 3, wherein the conveying speed of the first conveying device and of the additional conveying devices at least temporarily correspond to the conveying speed of the second conveying device.

5. The guiding and stacking system according to claim 1, wherein the first conveying device is arranged to be driven by its associated driving device in the start/stop operation.

6. The guiding and stacking system according to claim 1, wherein the additional conveying devices have a uniform conveying speed and are driven in their entirety by their driving devices in the start/stop operation.

7. The guiding and stacking system according to claim 1, wherein the additional conveying devices are divided and each have at least one section which is configured to be driven in the start/stop operation, the remaining part of the additional conveying devices having a uniform constant conveying speed.

8. The guiding and stacking system according to claim 1, wherein the second conveying device is continuously driven by its associates driving device.

9. The guiding and stacking system according to claim 1, wherein an average speed of the first conveying device and average speeds of the additional conveying devices are lower than the conveying speed of the second conveying device.

10. The guiding and stacking system according to claim 1, wherein, starting from the distributing guide, the guiding and stacking transport systems are directed to difference stacking sites.

11. The guiding and stacking system according to claim 1, wherein at least one gripper device respectively is operatively associated with the removal transport system as well as the guiding and stacking transport systems.

12. A guiding and stacking method for a press system comprising, receiving side-by-side sheet metal parts from a press and transporting the side-by-side sheet metal parts to a distributing guide having a second conveying device, receiving the side-by-side sheet metal parts at the second conveying device and transporting the side-by-side sheet metal parts to a region of the distributing guide adjacent stacking transport systems each having an additional conveying device, changing the distributing guide between one position which adjoins one of the guiding and stacking transport systems, and another position which adjoins another of the guiding and stacking transport systems, and transporting the side-by-side sheet metal parts to a selected one of the stacking transport systems via the one position or the another position.

* * * * *